United States Patent [19]

Slayton

[11] 4,178,765

[45] Dec. 18, 1979

[54] MEANS FOR CAUSING THE ACCUMULATION OF REFRIGERANT IN A CLOSED SYSTEM

[75] Inventor: Curtis R. Slayton, Fern Creek, Ky.

[73] Assignee: General Electric Company, Louisville, Ky.

[21] Appl. No.: 920,098

[22] Filed: Jun. 28, 1978

[51] Int. Cl.[2] ..... F25B 43/00; F25B 43/02; F25B 39/04

[52] U.S. Cl. ..... 62/83; 62/84; 62/474; 62/509

[58] Field of Search ..... 62/83, 84, 85, 115, 62/468, 469, 470, 474, 509; 417/372

[56] References Cited

U.S. PATENT DOCUMENTS

| | | | |
|---|---|---|---|
| 1,823,353 | 9/1931 | Davenport | 62/509 |
| 2,158,403 | 5/1939 | Chamberlain | 62/509 |
| 2,171,814 | 9/1939 | Swart | 62/83 |
| 2,175,913 | 10/1939 | Philipp | 62/207 |
| 2,749,723 | 6/1956 | Webber | 62/474 |
| 2,760,355 | 8/1956 | Swart | 62/509 |
| 3,180,567 | 4/1965 | Quiggle et al. | 62/83 |
| 3,577,741 | 5/1971 | Shaw | 62/84 |

*Primary Examiner*—Lloyd L. King

*Attorney, Agent, or Firm*—Frank P. Giacalone; Radford M. Reams

[57] ABSTRACT

A compression refrigeration system having means for causing the accumulation of refrigerant in a selected area when the refrigeration system is inactive by providing a reservoir having a material therein that has greater miscibility with refrigerant than the compressor lubricating oil so that the liquid refrigerant within the inactive sealed system will migrate by gaseous transfer into the lower pressure area in the reservoir and go into solution with the material.

17 Claims, 7 Drawing Figures

MEANS FOR CAUSING THE ACCUMULATION OF REFRIGERANT IN A CLOSED SYSTEM

BACKGROUND OF THE INVENTION

This invention relates to a refrigeration system and more particularly to a refrigeration system including a hermetic motor-driven compressor that is exposed to outdoor ambient temperatures with certain other components of the system.

It is desirable that the compressor in a refrigeration system be lubricated with oil-refrigerant solution rich in oil at all times during start up and stable running conditions. Because of increased oil temperatures during running, the compressor lubricating oil will contain in solution only a small amount of refrigerant. However, during off periods the compressor and lubricating oil will come to ambient temperature following a diurnal cycle which will lag the other system component temperatures because of its mass. The vapor pressure of the oil/refrigerant solution in the compressor sump is less than the vapor pressure of the remaining pure refrigerant at equal system temperatures and considerably less when the compressor is at a lower temperature than the other components.

During these diurnal temperature cycles, refrigerant present in the system as a liquid will migrate by gaseous transfer to the oil in the compressor sump. If the system is allowed to remain off for a long enough period, all the liquid refrigerant will migrate to the compressor. The lubricating oil will continue to absorb refrigerant and two-phasing, i.e. oil rich/liquid refrigerant rich separation, will occur. The refrigerant will continue to migrate into the compressor and collect as refrigerant rich liquid in the bottom of the sump (refrigerant heavier than oil) until all the liquid refrigerant in the remaining system has been transferred to the compressor. If the compressor is started during the time when extreme oil dilution and/or two-phasing is present in the sump, bearing damage and subsequent compressor failure can occur.

The most common prior art means of preventing two-phasing of refrigerant and oil or extreme oil dilution from occurring is to provide heat to the oil sump generally using an external-type resistance heater attached to the compressor case in the sump area as shown in U.S. Pat. Nos. 2,175,913-Philipp and 3,577,741-Shaw. The purpose of the heater as is known in the art is conventionally to attempt to keep the compressor warm enough to avoid extreme oil dilution and the collection of liquid refrigerant in the compressor housing. These heaters when employed must have enough wattage to raise the sump temperatures high enough to maintain the sump temperature generally higher than the remaining outdoor component temperatures. This method of two-phase control reduces the system EER thus increasing energy usage and general operating costs.

Besides the problem of two-phasing, the presence of liquid refrigerant anywhere in the system can present a problem during initial start up of the compressor. Since the compressor is designed to compress refrigerant in its gaseous state any liquid refrigerant that may be injected into the compressor at start up can cause both bearing and valve damage.

SUMMARY OF THE INVENTION

By the present invention a refrigeration system is provided including in series a condenser, an evaporator, an expansion device arranged intermediate the condenser and evaporator dividing the system into high and low pressure portions. A hermetic compressor having a sump portion containing a supply of lubricating oil for the compressor. A reservoir connected in communication with the system. The reservoir contains a material having higher solubility for refrigerant relative to the lubricating oil. The volume of the material is an amount sufficient to absorb most of the refrigerant which can exist as a liquid in the system.

One object of the invention is to provide a means for causing liquid refrigerant when present to collect at a predetermined portion of the sealed system.

Another object of the invention is to prevent liquid refrigerant from flowing into the compressor cylinder during initial start up.

DESCRIPTION OF THE PREFERRED EMBODIMENT

Figure 1:
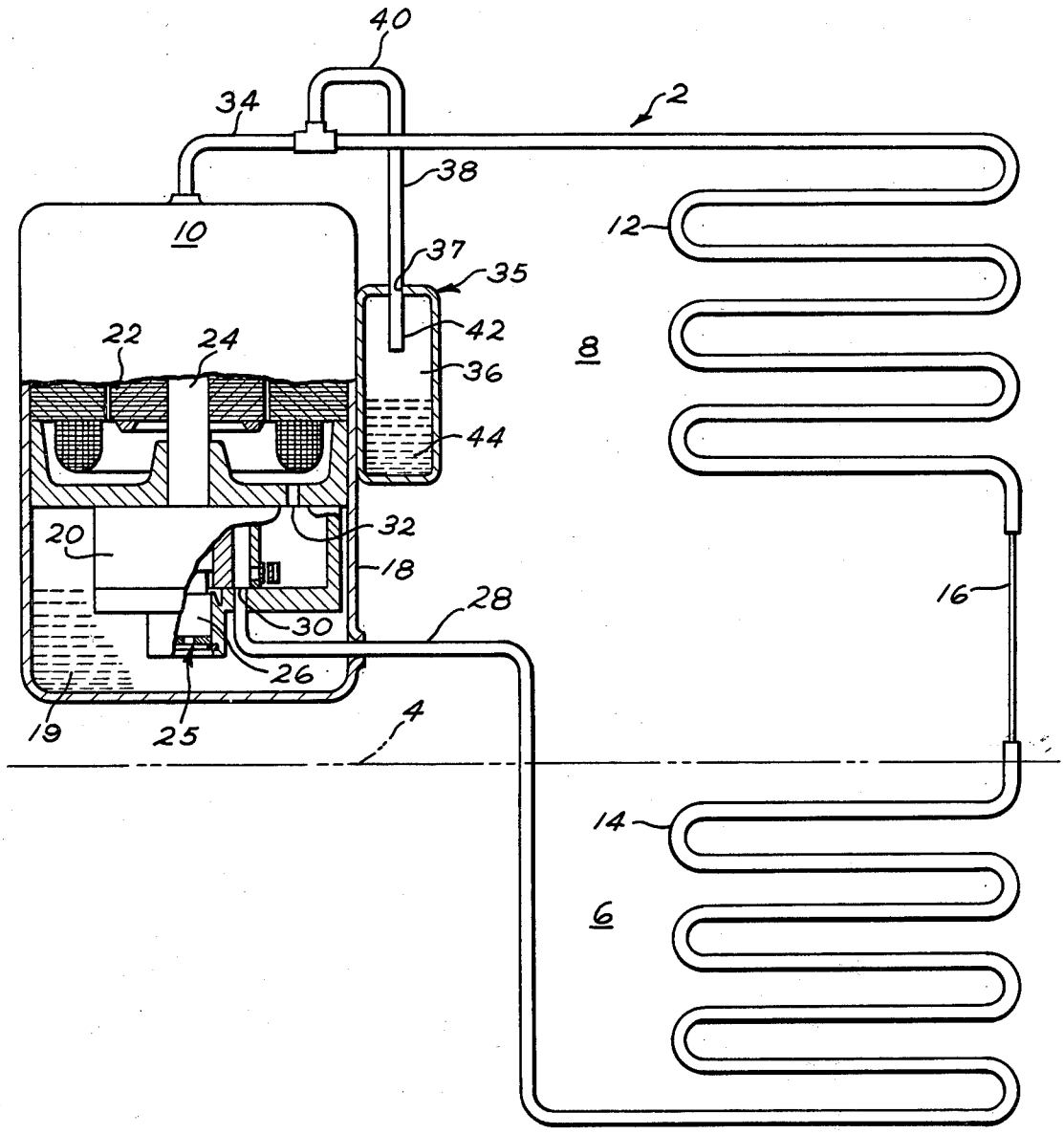
FIG. 1 illustrates schematically a refrigeration system embodying the present invention.

Referring to the drawing, there is shown schematically a refrigeration system divided by means of a partition 4 into a indoor section 6 and an outdoor section 8. A hermetically sealed refrigerant compressor 10 which forms a part of a refrigerant system including a condenser 12, an evaporator 14, and an expansion device 16 is shown in the embodiment of FIG. 1 in the form of a capillary. The above components including the compressor 10, condenser 12, expansion device 16, and evaporator 14 are connected in a closed refrigerant flow relationship with expansion device 14 dividing the system into high and low pressure portions.

The compressor 10 includes a hermetically sealed casing 18 having arranged in its lower or sump portion 19 a compressor unit 20. Mounted above the compressor unit 20 is a drive motor 22 which drives the compressor 20 through a shaft 24 supported in a lower bearing area 26.

During operation of the compressor, refrigerant at low pressure is withdrawn from the evaporator 14 through a suction line 28 which connects with the suction port 30 of the compressor 20. The refrigerant gas is compressed within the compressor 20 to a relatively high pressure and temperature and is then discharged by the compressor 20 through a suitable discharge passage 32 leading into the casing 18. After flowing upwardly over the motor 22, the high pressure gas is conducted out of the casing 18 through a discharge line 34 into the condenser 12 where the heat absorbed by the refrigerant in the other portions of the system is extracted. As the gas is cooled, it condenses so that the refrigerant in the latter stages of the condenser is largely in liquid form. The liquid refrigerant then passes through the expansion device 16 and is discharged as a liquid at low pressure to the evaporator 14 where it vaporizes into a low pressure gas and absorbs heat of vaporization and then back into the compressor 20 through suction line 28.

The compressor bearings including the lower bearing 26 is lubricated by an appropriate oil or lubricant shown in broken lines. The level of lubricant is sufficient to maintain a level in the sump 19 above the lower portion of bearing 26 so that an oil pump generally designated 25 can lift and direct the lubricant to the appropriate compressor parts. The system thus far described is conventional and, as such, by itself forms no part of the present invention.

As mentioned hereinbefore when the system is inactive the refrigerant tends to migrate to the coldest spot or portion of the system which during certain times and temperature conditions is the compressor. When enough refrigerant accumulates in the compressor, two liquid phases will form with the heavier refrigerant rich phase at the bottom. In this situation the oil may be above the oil pump intake 25 and damage can occur if the compressor is energized in that refrigerant rather than lubricant will be pumped into the bearings. To this end means are provided by the present invention that effectively prevents the accumulation of refrigerant in the compressor sump and any resultant oil dilution and two-phasing between oil and refrigerant in the sump.

The means in the present embodiment includes a body member 35 forming a sealed reservoir 36. The member 35 in the embodiment shown in FIG. 1 is arranged in heat exchange relationship with the compressor casing and has an opening 37 at its upper end. The body member 35 is connected so as to be in fluid communication with the high pressure portion of the system. It has been determined that a satisfactory point for making this connection is the discharge line 34 intermediate the compressor discharge and the condenser. It should be noted, however, as will be explained hereinafter, that connections at other points in the system may also provide the desired results. Accordingly, in the embodiment of FIG. 1 the opening 37 of reservoir 36 is coupled as by a conduit 38 to discharge line 34. Conduit 38 is connected to line 34 so as to extend upwardly therefrom at one end and then downwardly to form a loop portion 40. The loop portion 40 in this instance prevents compressor oil when present in the line 34 from flowing into the reservoir 36 by gravity. The other open end of conduit 38 extends through opening 37 and into the reservoir 36 a predetermined distance.

Means are provided in the reservoir that will cause the condensed refrigerant in the system to migrate by gaseous transfer into the reservoir instead of into the compressor sump when the system is inactive.

To accomplish this a material 44 is arranged in the reservoir that essentially has a higher solubility with refrigerant relative to the lubricating oil. The refrigerant in the system has a greater solubility in the material than it has with the compressor lubricating oil.

Materials used in carrying out the present invention were an alkylbenzene liquid and a polyester liquid having such chemical compositions as to remain liquids at all ambient operating temperatures encountered by the reservoir. Typical examples are an alkylbenzene with a viscosity of 150 SUS at 100° F., pour point of −50° F., specific gravity of 0.872, and a molecular weight of 320. A polyester fluid used in the present invention was a pentaerythritol ester with a viscosity of 150 SUS at 100° F. and a pour point of −50° F.

While the above materials were employed successfully in carrying out the present invention it should be noted that there may be other materials that may give similar results provided they have higher solubility for the refrigerant and meet other requirements. For example the material 44 should have:

(1) Low vapor pressure to prevent migration into the refrigeration system.

(2) Non-foaming, to avoid liquid carryover into system.

(3) Chemical compatibility, in the event very small amounts are carried out.

In carrying out the present embodiment, in a sealed refrigeration system, 448 cc of polyester oil was arranged in the reservoir. The reservoir having a volume of about 1300 cc was employed in a refrigeration system having the below described parameters.

In a typical room air conditioning system, the total system volume may consist of the compressor (75 in.$^3$), evaporator (65 in.$^3$), condenser (92 in.$^3$), accumulator (20 in.$^3$), modulator (14 in.$^3$), and connecting tubing (15 in.$^3$) equaling abut 280 in.$^3$ or 0.162 ft.$^3$.

The refrigerant charge would be 1.7 lbs. and the oil charge 325 cc or 0.0115 ft.$^3$ liquid volume in the compressor.

System volume 0.163 ft.$^3$

Oil Charge 0.0115 ft.$^3$ 0.645 lbs.

R-22 Charge 1.167 lbs.

If we assume that the outdoor side of the system is in a 50° F. environment and all the refrigerant oil is contained in the compressor sump, the following essentially static conditions will exist.

(a) The saturation pressure of R-22 at this temperature is about 99 PSIG and this pressure exists throughout the system.

(b) From miscibility diagrams, the solubility of R-22 in 200 SSU white oil at 50° F. is about 42 wt-%, where wt-%=(wt R-22/wt R-22+wt oil). This means that the sump oil will contain under static conditions, 42 wt-% R-22 or $$\text{wt } R-22 = \frac{(\text{wt} - \%\ R - 22)(\text{wt. oil})}{1 - \text{wt} - \%\ R - 22}$$

$$\text{wt } R-22 = \frac{(.43)(.645\#)}{1 - .42} = \frac{.467\#}{}$$

(c) The density of R-22 vapor at 50° F. is 1.8 #/ft.$^3$, therefore the system free volume contains 1.8 #/ft.$^3$, × 162 ft.$^3$ or 0.292# R-22 vapor.

(d) Under static conditions there will exist 1.67# − (0.467# + 0.292#) or 0.911# R-22 in liquid form within the system and will have migrated to the coldest point.

Figure 2:
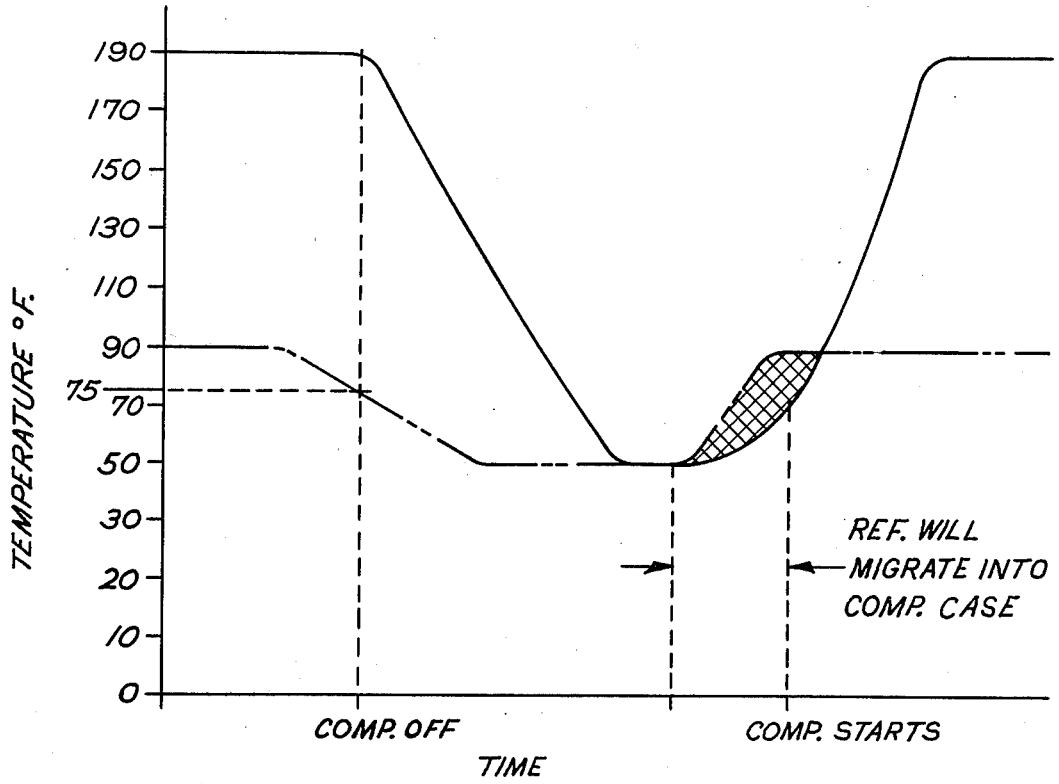
FIG. 2 is a graph showing the temperature cycle of the air conditioner components.

The following is a brief description of conditions wherein refrigerant will normally migrate to the compressor casing during a typical temperature cycle as shown in FIG. 2 of the drawings. The ambient temperature as shown in broken lines might typically range from a mid-day high of 90° F. to a nighttime low of 50° F. although the typical diurnal swing may be 30° F. As the outdoor ambient drops below 75° F., which may be substantially the desired comfort temperature selected for indoor comfort, the compressor will be de-energized and remain de-energized for as long as the temperature remains at or below the selected comfort temperature.

With the system inactive, the compressor temperture shown in solid line will start to drop from its normal operating temperature which may be 190° F. until it is at the low outdoor ambient which is illustrated as 50° F. Because of its mass the drop in compressor temperature lags both the outdoor ambient and the other system components and the refrigerant will remain in the system and not migrate to the warmer compressor.

As the outdoor ambient temperature begins to climb from its over-night low of 50° F., particularly after sunrise, the system components will warm up at substantially the same rate as the outdoor ambient temperature, while the rise in compressor temperature because of its mass will lag ambient as shown.

It is during the time lag when the rising compressor temperature is substantially lower than outdoor and system component temperatures that refrigerant will, as explained hereinafter, migrate into the colder compressor.

With the present invention incorporated in the closed refrigeration system, refrigerant in the portions of the system which have a higher vapor pressure than reservoir 36 will now migrate into the reservoir which has the lowest vapor pressure in the system and be absorbed into the material therein. In effect with the material used in carrying out the present invention, the vapor pressure in the region of the reservoir above the material and refrigerant solution is less than that of the region above the compressor oil and refrigerant.

It has further been determined that the vapor pressure of the refrigerant over the polyester oil and over the compressor oil became essentially equal at 20° F. $\Delta T$, that is the polyester oil could be 20° warmer than the compressor oil and still absorb half of the available liquid R-22.

Figure 3:
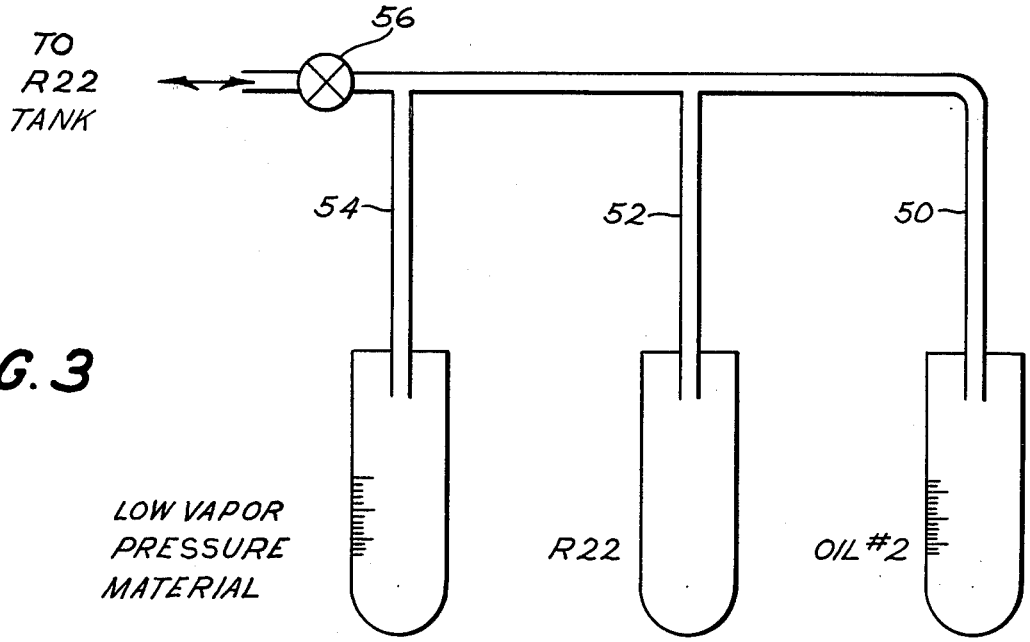
FIG. 3 is a schematic illustration of an apparatus used in testing the present invention.
Figure 4:
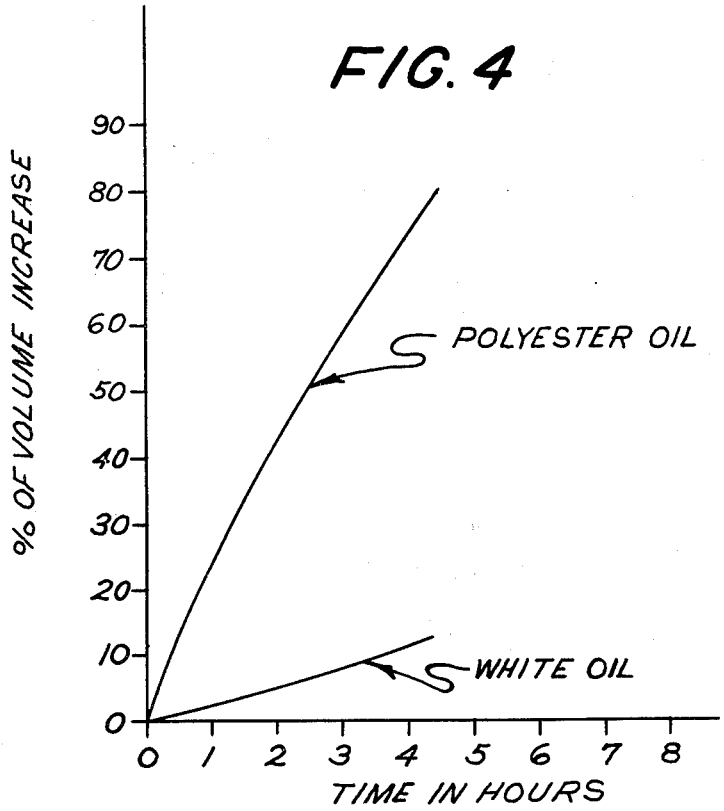
FIG. 4 is a graph illustrating the absorbing qualities of a first material.
Figure 5:
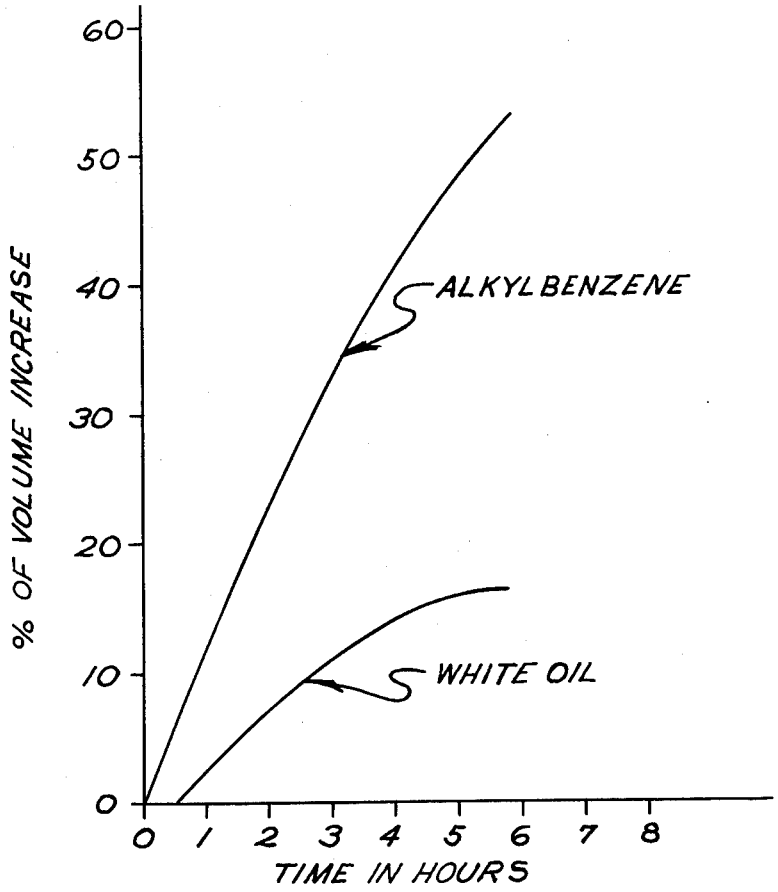
FIG. 5 is a graph illustrating the absorbing qualities of a second material.

Test information was developed on the relative absorption rate of Refrigerant R-22 for the white oil versus the alkylbenzene and the polyester oil. These absorption tests were conducted on the apparatus shown in FIG. 3 of the drawings. The apparatus consisted of a first container 50 for holding a volume of white oil as employed in the refrigeration system, a second container 52 for holding a volume of refrigerant R-22 as employed in the system, and a third container 54 for holding a volume of material 44 as employed in reservoir 36. The containers all being interconnected by tubing to form a closed system. The first test shown in the graph of FIG. 4 was conducted with equal amounts of polyester oil as the material, white oil and refrigerant R-22 added to the containers, and the system sealed by a valve 56. The graph indicates the percentage volume change at ambient temperatures with time. At room temperature, polyester oil absorbs 75% of its own volume of R-22 as against 10% for the white oil in the same closed system. Referring to the graph shown in FIG. 5 is the result when alkylbenzene was used as the material with the corresponding values for alkylbenzene over white oil being about 57% versus 14%.

While the exact location of the body member 35 is not critical in carrying out the present invention, it has been found advantageous to arrange the member 35 so that it is in the same ambient with the compressor on the outside section of the unit and in close proximity or against the compressor casing. In this manner, it will always be at approximately the same temperature of the compressor and will draw compressor heat so that it will quickly reach compressor temperature after the compressor starts up. This will cause the refrigerant when in solution with the material in the reservoir to be driven out of the reservoir and back into the system in a relatively short time after the compressor starts up.

Figure 6:
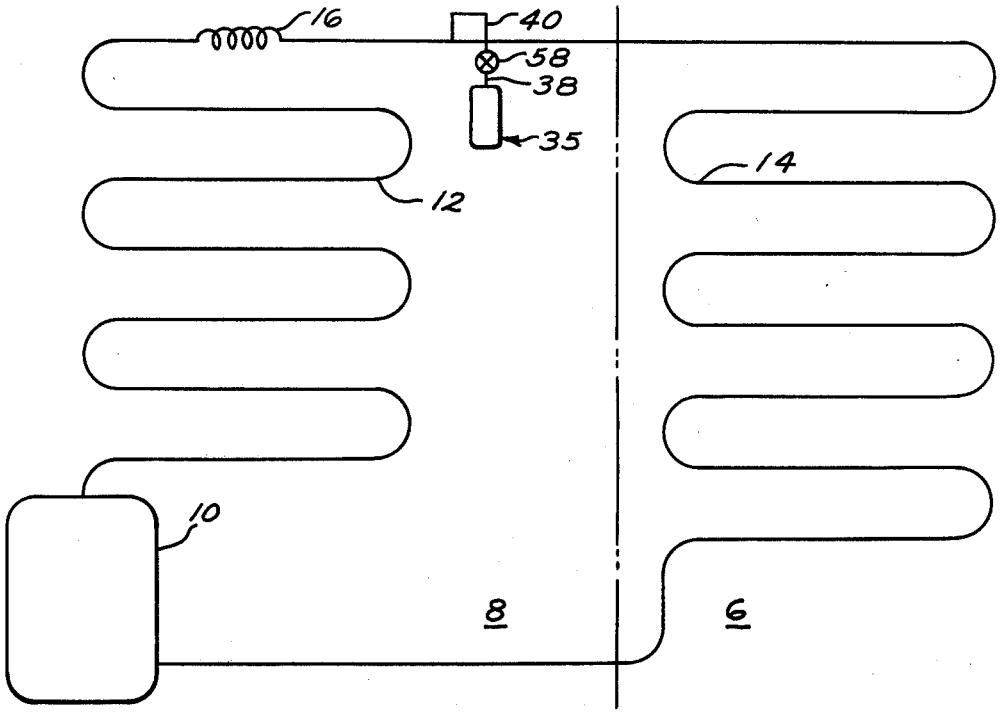
FIG. 6 illustrates schematically a refrigeration system embodying another embodiment of the present invention.
Figure 7:
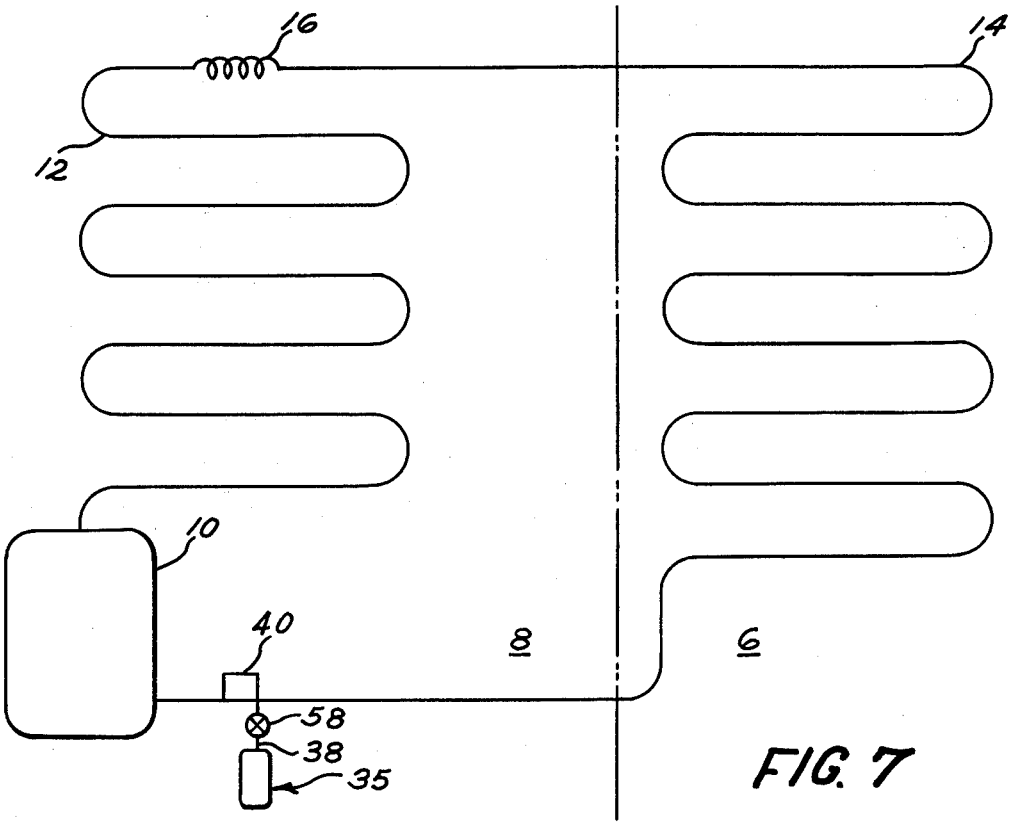
FIG. 7 illustrates schematically a refrigeration system of still another embodiment of the present invention.

In carrying out the present invention of providing means for collecting liquid refrigerant when the system is inoperative the reservoir is described hereinabove as connected into the high side of the system with reservoir 35 in heat exchange relationship with the compressor casing, however, other locations have also been found effective. Referring now to FIG. 6 the reservoir 35 arranged in the outdoor section 8 is connected by conduit 38 at some point between the expansion device 16 and the entrance to the evaporator 14. With reference to FIG. 7 it will be seen that the reservoir 35 is connected by conduit 38 at some point in the suction line 28 that is located in the outdoor section 8. Due to the system operating temperatures and pressures present in the low side portion of the system the reservoir need not be arranged in heat exchange relationship with the compressor casing since the added heat of the compressor casing is not required to drive the refrigerant from the reservoir.

It may also be desirable in certain instances, particularly when the reservoir is placed in communication with the suction line that a flow control means or restrictor 58 be arranged at some point in line 38. It is possible when the reservoir is in communication with the suction line as shown in FIG. 7 that at initial start up a vacuum can be pulled on the reservoir which would cause the material to be driven out of the reservoir with the refrigerant. To prevent this the restrictor or valve 58 is dimensioned to provide sufficient flow for gaseous refrigerant to enter the reservoir during compressor system shut down while also providing a restricted flow for refrigerant to reenter the system from the reservoir at start up. The restricted flow prevents the material 44 from being driven out of the reservoir 35 with the refrigerant during extreme conditions or pressure differentials.

In summary, when the reservoir containing a material of the amount and qualities described hereinbefore is placed in communication with the sealed refrigeration system as disclosed, refrigerant will migrate into solution with the material rather than migrate into the compressor or in solution with the compressor oil when conditions in the system are such that the refrigerant vapor pressure over the material in the reservoir is at least as low as the refrigerant vapor pressure over the lubricating oil in the compressor sump and accordingly the amount of refrigerant present in the compressor or sump area will be diminished during compressor start up.

During an off cycle the material in the reservoir will pull much of the refrigerant charge into the reservoir. While this results in essentially having a system that at startup is undercharged, it should be noted, as the compressor comes up to temperature in the embodiment of FIG. 1, the heat transfer to the reservoir will drive out the trapped refrigerant thereby resulting in normal operation. The start up and warmup of the compressor will be with a very light charge resulting in minimum loading during start up when loading is critical. In any event the provision of the present invention of a reservoir containing a material as disclosed, placed in communication with the refrigeration system, is effective in eliminating the presence of liquid refrigerant in the compressor during initial startup. It should be understood that while satisfactory results were obtained with the reservoir 35 and material 44 arranged as shown in the present embodiments, it is possible that other locations in the refrigeration system would also provide the desired results.

It should be apparent to those skilled in the art that the embodiment described heretofore is considered to be presently preferred form of this invention. In accordance with the Patent Statutes, changes may be made in the disclosed apparatus and the manner in which it is used without actually departing from the true spirit and scope of this invention.

What is claimed is:

1. A refrigeration system comprising:

a condenser, an evaporator, a hermetic compressor casing in a sealed series circuit, for permitting circulation of a charge of refrigerant, an expansion device intermediate said condenser and evaporator dividing said system into a high and low pressure portion, said hermetic compressor casing having a refrigerant compressor for compressing refrigerant gas and a motor for driving said compressor, and a sump portion containing a supply of lubricating oil for said compressor, a member providing a sealed reservoir, having an opening in its upper portion, means connecting said reservoir in sealed communication with said system, a material arranged in said reservoir having a high solubility for refrigerant relative to said lubricating oil in said casing sump, the volume of said material being an amount sufficient to cause enough of said refrigerant charge in said system to migrate as a vapor into the lower pressure area of said reservoir and into solution with said material so that liquid refrigerant present when the system is inactive will collect in the reservoir.

2. The invention recited in claim 1 wherein said reservoir is arranged in heat exchange relationship with said compressor casing.

3. A refrigeration system comprising:

a condenser, an evaporator, a hermetic compressor casing in a sealed series circuit, for permitting circulation of a charge of refrigerant, an expansion device intermediate said condenser and evaporator dividing said system into a high and low pressure portion, said hermetic compressor casing having a refrigerant compressor for compressing refrigerant gas and a motor for driving said compressor, and a sump portion containing a supply of lubricating oil for said compressor, means including a discharge opening in said casing and a discharge conduit for directing high pressure refrigerant from said compressor to said high pressure portion of said system, and a suction opening for directing low pressure refrigerant to said compressor from said low pressure portion of said system, a member providing a sealed reservoir having an opening in its upper portion, a conduit connected at one end to said opening in said reservoir and having its other end connected in said system to place said reservoir in sealed communication with said system, a material arranged in said reservoir having a high solubility for refrigerant relative to said lubricating oil in said casing sump, the volume of said material being an amount sufficient to cause enough of said refrigerant charge in said system to migrate as a vapor into the lower pressure area of said reservoir and into solution with said material so that liquid refrigerant present when the system is inactive will collect in the reservoir.

4. The invention of claim 3 wherein said reservoir is arranged in heat exchange relationship with said compressor casing.

5. The invention as recited in claim 3 wherein said other end of said conduit is connected at a point in said high pressure portion of said system.

6. The invention as recited in claim 4, wherein said other end of said conduit is connected to said discharge conduit.

7. The invention as recited in claim 6 wherein a portion of said conduit extending from said discharge line extends upwardly therefrom to prevent gravity flow of fluid from said system to said reservoir.

8. The invention as recited in claim 7, wherein said material in said reservoir is a polyester fluid having a viscosity of 100 to 200 SUS at 100° F. and a pour point of −75° F. to −25° F.

9. The invention as recited in claim 7, wherein said material in said reservoir is an alkylbenzene having a viscosity of 100 to 200 SUS at 100° F. and a pour point of −75° F. to −25° F.

10. The invention as recited in claim 8, wherein the polyester fluid is a pentaerythritol ester.

11. The method of causing liquid refrigerant into a preselected area in a sealed inactive refrigeration system including an oil lubricated compressor to migrate which comprises:

providing a member forming a sealed reservoir, providing means connecting said resevoir in fluid communication with said sealed system, arranging a volume of material in said reservoir having greater miscibility with said refrigerant relative to said compressor oil, absorbing substantially all of said refrigerant which can exist as a liquid into the lower pressure area of said reservoir and into solution with said material when said system is inactive; and allowing said refrigerant to migrate back into said system when said compressor operation causes a temperature rise in said reservoir that is sufficient to drive out the refrigerant that is in solution with said material.

12. A method of causing liquid refrigerant into a preselected area in a sealed inactive refrigeration system including a condenser, an evaporator, oil lubricated hermetic compressor in a sealed circuit, for permitting circulation of a charge of refrigerant, an expansion device intermediate the condenser and evaporator dividing the system into a high and low pressure portion, which comprises:

providing a member forming a sealed reservoir;

providing means connecting said reservoir in fluid communication with the high pressure portion of said system;

arranging a volume of material in said reservoir having higher solubility with said refrigerant relative to said compressor oil;

absorbing substantially all of said refrigerant which can exist as a liquid into the lower pressure area of said reservoir and into solution with said material when said system is inactive; and allowing said refrigerant to migrate back into said system when said compressor operation causes a temperature rise in said reservoir that is sufficient to drive out the refrigerant that is in solution with said material.

13. The method recited in claim 11 wherein said means connecting said reservoir is a conduit arrange to provide fluid communication between said high pressure portion of said system and said reservoir.

14. The method recited in claim 12 wherein the material in said reservoir is a polyester fluid having a viscosity of 100 to 200 SUS at 100° F. and a pour point of −75° F. to −25° F.

15. The invention recited in claim 13 wherein the polyester fluid is a pentaerythritol ester.

16. The method recited in claim 12 wherein said conduit is arranged to provide fluid communication from a point in the system between the compressor and condenser and said reservoir.

17. The method recited in claim 11 wherein said means connecting said reservoir is a conduit arranged to provide fluid communication between said low pressure portion of said system and said reservoir.

* * * * *